US006470611B1

(12) United States Patent
Conway et al.

(10) Patent No.: US 6,470,611 B1
(45) Date of Patent: Oct. 29, 2002

(54) TWO-POSITION VERTICALLY ADJUSTABLE SIGN

(75) Inventors: Thomas M. Conway, Chicago, IL (US); Scott Padiak, Winnetka, IL (US)

(73) Assignee: Cormark, Inc., Elk Grove Village, IL (US)

( * ) Notice: Subject to any disclaimer, the term of this patent is extended or adjusted under 35 U.S.C. 154(b) by 0 days.

(21) Appl. No.: 09/275,929

(22) Filed: Mar. 24, 1999

(51) Int. Cl.[7] ..... G09F 15/00

(52) U.S. Cl. ..... 40/606; 40/601; 248/320; 211/189

(58) Field of Search ..... 40/124, 601, 606; 248/320, 321, 245; 211/189

(56) References Cited

U.S. PATENT DOCUMENTS

| | | | |
|---|---|---|---|
| 268,616 | A | 12/1882 | Brown |
| 629,021 | A | 7/1899 | True |
| 1,111,458 | A | 9/1914 | Hight |
| 1,199,848 | A | 10/1916 | Willoughby |
| 1,220,758 | A | 3/1917 | Lamphiear |
| 1,559,010 | A | 10/1925 | Schwieger |
| 1,793,563 | A | 2/1931 | Schwartz |
| 1,866,723 | A | 7/1932 | Powers |
| 2,646,241 | A | 7/1953 | McLean |
| 2,738,987 | A | 3/1956 | McDonald |
| 2,787,433 | A | 4/1957 | Slavsky et al. |
| 2,845,729 | A | 8/1958 | Baumgart |
| 3,082,989 | A | 3/1963 | Bower |
| 3,102,351 | A | 9/1963 | Howell |
| 3,113,677 | A | 12/1963 | Johnson |
| 3,529,798 | A | 9/1970 | Williams et al. |
| 3,669,392 | A | 6/1972 | Saunders |
| 3,969,838 | A | 7/1976 | Moore |
| RE30,734 | E | 9/1981 | Eckert |
| 4,344,244 | A | 8/1982 | Tyke |
| 4,369,948 | A | 1/1983 | Krauss et al. |
| 4,531,311 | A | 7/1985 | Howard et al. |
| 4,574,507 | A | 3/1986 | Elliott |
| 4,593,486 | A | 6/1986 | Visocky et al. |
| 4,616,799 | A | 10/1986 | Rebentisch |
| 4,709,891 | A | 12/1987 | Barnett |
| 4,729,183 | A | 3/1988 | Tarter et al. |
| 4,791,739 | A | 12/1988 | Hetzer |
| 4,798,013 | A | 1/1989 | Sainato |
| 4,805,331 | A | 2/1989 | Boggess et al. |
| 4,821,437 | A | 4/1989 | Abramson et al. |
| 4,866,867 | A | 9/1989 | Clark |
| 4,869,376 | A | 9/1989 | Valiulis et al. |
| 4,881,707 | A | 11/1989 | Garfinkle |

(List continued on next page.)

*Primary Examiner*—J. J. Swann
*Assistant Examiner*—Andrea Chop
(74) *Attorney, Agent, or Firm*—Welsh & Katz, Ltd.

(57) ABSTRACT

A two-position vertically adjustable sign system is used for mounting display media to an associated vertically oriented rack or shelf. The adjustable sign system includes a frame having upper and lower frame members for supporting the media. The system further includes mounting brackets for mounting to the shelf or rack. Each bracket defines an opening therein and has an engaging wall that extends from a rear portion of the bracket inwardly of the opening. A slide beam is associated with each mounting bracket, and is fixedly connected to the frame at the upper and lower frame members. Each beam is slidingly received in its respective mounting bracket opening for vertically adjusting the frame between a display position and a storage position. The beams each include an engaging flange extending from a rear portion thereof for engagement with its respective bracket engaging wall to maintain the frame in the display position. Each beam further includes an upper end termination portion to secure to the frame and to maintain the frame in the storage position and a lower termination portion for securing to the frame.

4 Claims, 3 Drawing Sheets

U.S. PATENT DOCUMENTS 4,884,351 A 12/1989 Abramson
4,909,464 A 3/1990 Levine et al.
4,957,256 A 9/1990 Boeding
5,106,046 A 4/1992 Rowles et al.
5,111,606 A 5/1992 Reynolds
5,143,337 A 9/1992 Tomayko, Jr. et al.
5,189,822 A 3/1993 Schmanski et al.
5,230,174 A 7/1993 Reed
5,237,767 A 8/1993 Kringel et al.
5,383,793 A 1/1995 Hsu et al.
5,408,775 A 4/1995 Abramson et al.
5,472,289 A 12/1995 Kringel et al.
5,803,420 A 9/1998 Conway et al.
6,003,697 A * 12/1999 Ferchat et al. ..... 211/189

* cited by examiner 22
18
10
12
14
16
24
B
LUMBER
22
4"X4"X
20
4"X4"X16'

58
50
26
68
36
28
44
48
30
42
34
54
74
72
46
32
20

58
26
68
36
44
74
42
72

58
26
36
68

TWO-POSITION VERTICALLY ADJUSTABLE SIGN

FIELD OF THE INVENTION

The present invention pertains to a vertically adjustable, locking sign system. More particularly, the invention pertains to a sign system that permits the display portion of the sign to be moved in a vertical plane between one of two positions.

BACKGROUND OF THE INVENTION

Signs, and more particularly point of purchase sign or display systems can, when properly used, be tremendously effective marketing tools. To this end, point of purchase sign or display systems have become widely popular in all manner of retail and commercial trades.

Point of purchase displays and signs are available in a wide variety, from active signs, which may rotate or have other moving elements, to the more traditional, passive or stationary signs, such as overhead signs. While these signs will be well recognized in the traditional, retail setting, they are also becoming more popular for use in the fast-growing home improvement center retail market as well as the large "warehouse-club" types of establishments.

Many of these home improvement and warehouse-club establishments use conventional warehouse-type stocking arrangements, which include shelving systems that accept loaded pallets and palletized items onto the shelves, as well as traditional consumer-packaged items. While these pallet-receiving arrangements (e.g., pallet racks) provide an efficient me stocking and storing items, they often do not lend themselves to mounting conventionally known signs or display systems.

In addition to providing effective, eye-catching advertising media, these sign systems must also be designed to permit movement or removal of the sign to efficiently restock the shelves on which the sign is mounted. That is, because of the large amount of stock that can be placed on these shelves, the signs must be readily moveable so that shelves can be restocked. Often, the quantity of material that can be stored or stocked on these shelves is so large that forklifts, fork trucks or like equipment is used to elevate and place a pallet on the shelves of the rack system.

U.S. Pat. No. 5,803,420 to Conway et al., which patent is assigned to the assignee of the present application, discloses one effective sign mounting system that permits pivoting the sign to permit access to the shelves on which the sign is mounted. Although this is an effective sign system, there may be times when the configuration or layout of these pallet racks does not permit pivoting the sign to and from the display position for access to the shelves.

Accordingly, there is a need for a sign and mounting system that permits the use of large, advertising-effective media displays, which signs and mounting systems readily permit moving or repositioning the signs for access to the shelves on which the signs are mounted. Desirably, such signs and mounting systems are positionable in a substantially vertical plane, that is parallel to the face of the pallet rack, between a display position and a storage or restocking position in which the rack shelves can be accessed.

SUMMARY OF THE INVENTION

A two-position vertically adjustable sign system is used to mount display media, such as a sign, a poster or the like to an associated vertically oriented rack or shelf. The sign system includes a frame having upper and lower frame members for supporting the media.

The system includes at least two mounting brackets for mounting to the shelf or rack. Preferably, each bracket includes a front wall, a rear wall and a pair of side walls that define an opening in the bracket. An engaging wall extends inwardly of the opening from the rear wall portion of the bracket. The sign system includes a slide beam associated with each mounting bracket. The slide beams are fixedly connected to the frame at the upper and lower frame members. Each beam is slidingly received in its respective mounting bracket opening for vertically adjusting the frame between a display position and a storage position.

Each beam includes an engaging flange that extends from a rear portion of the beam and engages its respective bracket engaging wall to maintain the frame in the display position. Each beam further includes an upper end termination portion to secure to the frame and to maintain the frame in the storage position. A lower termination portion of the beam secures to the frame.

In a preferred embodiment, the bracket engaging wall is inclined, extending upwardly and inwardly of the bracket opening, and the beam engaging flange is inclined complementary to the bracket engaging wall to lock the frame in the display position.

The bracket engaging wall can be formed as a bifurcated wall defining a pair of wall portions and a track between the wall portions. The beam can include a rearwardly extending projection that is configured for receipt in the track, and the beam engaging flange can be formed as a pair of flanges, each a flange extending from a respective side of the projection. The projection arrangement provides additional support and centering of the beam in the bracket.

In one embodiment, the bracket includes a front wall that extends upwardly to a height that is less than a height of the bracket engaging wall. In this embodiment, the beam includes a recessed region on a front portion thereof at about the lower end termination portion. The front wall and the engaging wall are configured so that the beam can be assembled to the bracket by pivotal cooperation of lower end termination portion of the beam into the bracket opening.

Other features and advantages of the present invention will be apparent from the following detailed description, the accompanying drawings and the appended claims.

DETAILED DESCRIPTION OF THE PREFERRED EMBODIMENTS

Figure 1:
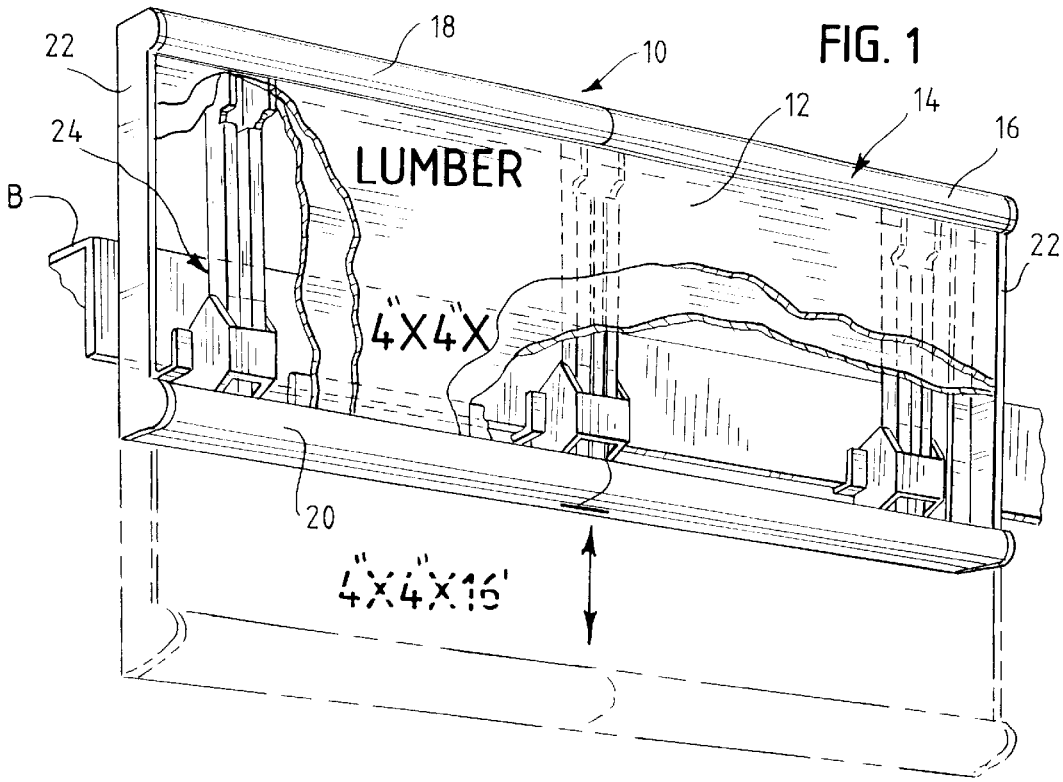
FIG. 1 is a front perspective view of a two-position vertically adjustable sign system in accordance with the principles of the present invention, the display portion of the sign being shown in the display position in solid lines and in the storage or restocking position in phantom lines.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

With reference now to the figures and in particular to FIG. 1, there is shown a two-position vertically adjustable sign system 10 in accordance with the principles of the present invention. The sign system 10 is illustrated mounted to a front beam B of a shelf or rack, and is used to support display media 12, such as a sign, poster or the like. In the illustrated embodiment, the display media 12 shown identifies a particular size, i.e., 4"×4"×16' of lumber. As seen in FIG. 1, the display portion 14 of the sign system 10 is movable between a display position shown in solid lines and a storage or restocking position shown in phantom lines.

The display portion 14 of the system 10 can include a frame 16 formed from parallel upper and lower frame members 18, 20, respectively, and transverse end members 22. The sign support portion, shown generally at 24, of the system 10 includes at least a pair of slide beams 26 that extend between and connect to the upper and lower frame members 18, 20. The slide beams 26, as will be discussed in detail below, provide structural support for the display portion 14 of the sign 10 as well as guides for vertically adjusting the display portion 14.

The sign system 10 includes at least a pair of mounting brackets 28, and preferably, one mounting bracket 28 associated with each of the slide beams 26. The mounting brackets 28 mount to the shelf B to support the display portion 14 and to provide sleeves through which their associated slide beams 26 traverse. Each mounting bracket 28 includes a bracket rear portion 30 defined by a horizontal wall 32 that is contiguous with an upstanding vertical wall 34. The bracket rear portion 30 is configured to rest against, engage and secure to the shelf or shelf beam B from which the sign system 10 is supported.

The bracket rear portion 30 has an L-shaped configuration to rest against and flush to the shelf B, and is formed having an upwardly inclined, bifurcated engaging portion or wall 36 that extends upwardly and inwardly, away from the rear portion 30 or shelf B. The bifurcated engaging wall 36 defines a track 38 between the bifurcations 36*a, b*. The mounting bracket 28 includes a pair of spaced apart side walls 40 and a front wall 42 which, together with the bracket rear portion 30 and engaging walls 36 define an opening or channel 44 through which the slide beam 26 traverses. The front wall 42 extends upwardly a short distance, and terminates below the height of the engaging wall 36. The bottom edge 46 of the front wall 42 provides a stop surface for engaging the slide beam 26.

The slide beam 26 traverses through the bracket opening 44 between the display position illustrated in solid lines in FIG. 1 and the storage or restocking position shown in phantom lines. The beam 26 includes an elongated central portion 50 and upper and lower end termination portions, 52, 54, respectively. As seen in FIG. 1, the beam 26 can be formed from a plurality of rib elements 56*a–d* rather than as a solid member. Preferably, the beam 26 is formed as a molded part, most preferably injection molded, with the end termination portions 52, 54 formed integral with the central portion 50. This manner of forming the beam 26 reduces the amount of material necessary while maintaining the strength required for the beam 26 to support the display portion 14, and also results in reduced beam weight. The beam central portion 50 is configured to readily slide through the bracket opening 44.

Figure 7:
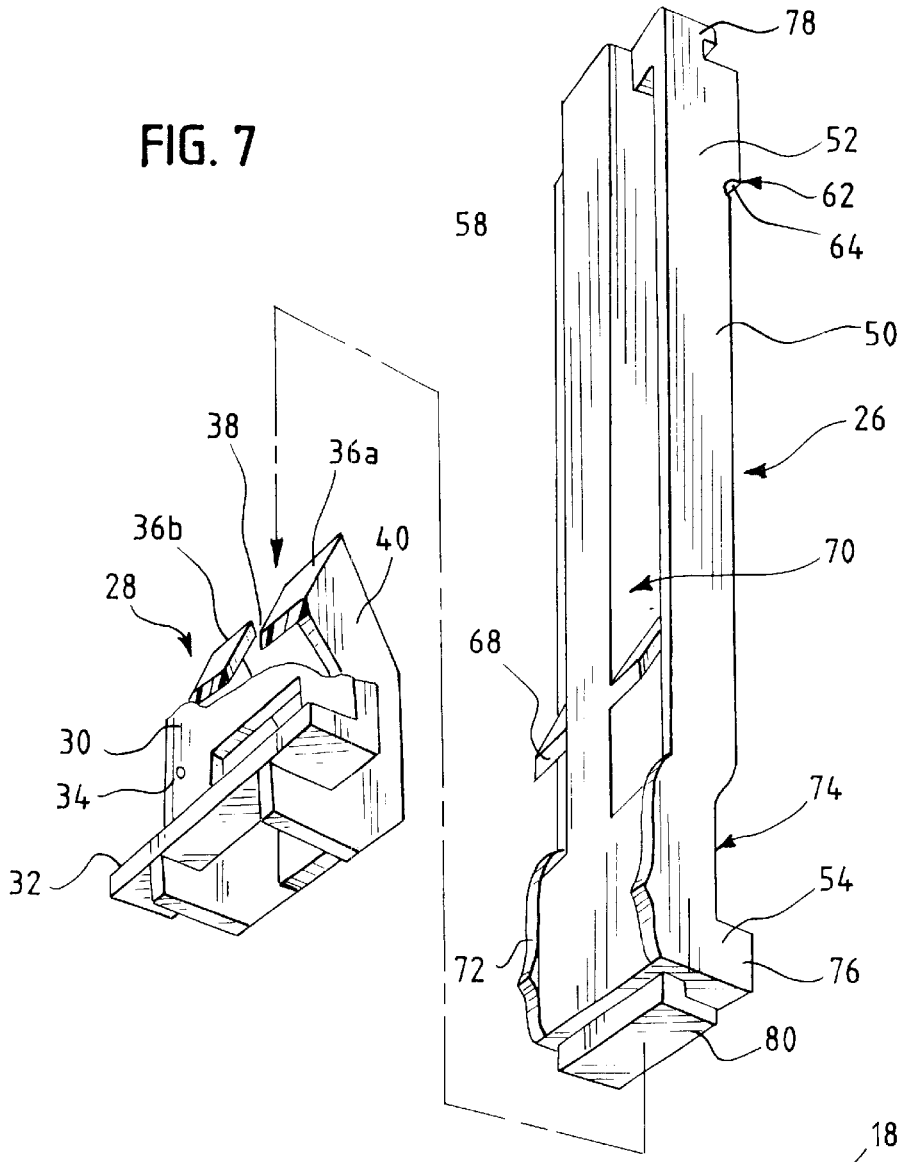
FIG. 7 is a partial, exploded view of the mounting bracket and slide beam of the present sign system.
Figure 8:
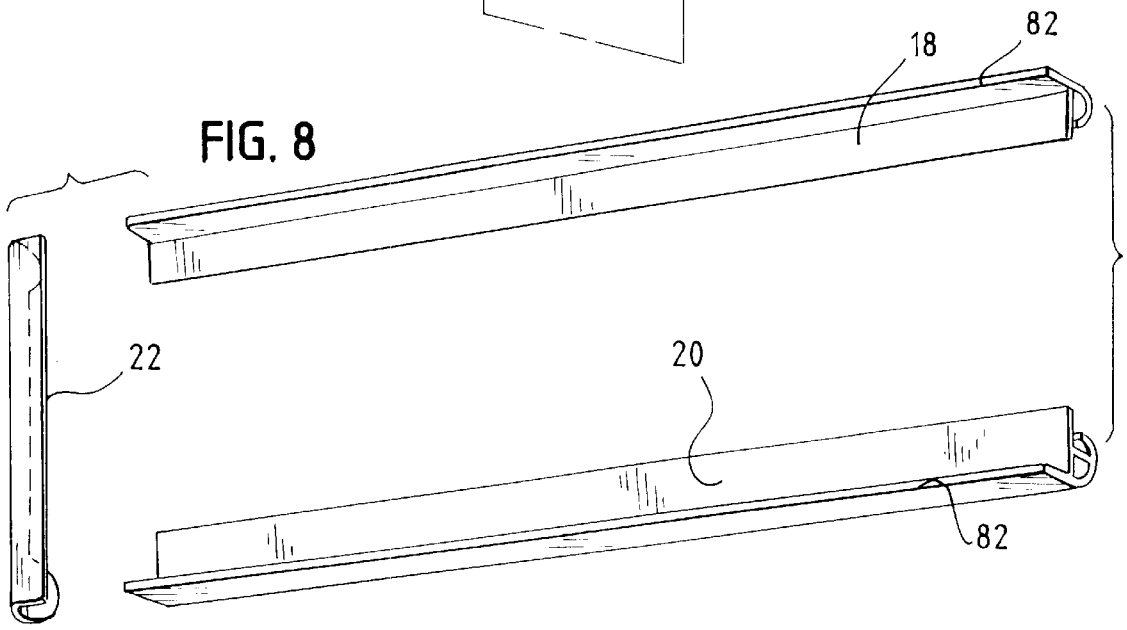
FIG. 8 is a partial, exploded view of the frame portion of the sign system.

Referring to FIG. 7, the slide beam 26 is formed having a pair of the ribs defining side walls 56*a,d* and a rearwardly extending, elongated projection 58 that extends between the lower end termination portion 54 and the upper end termination portion 52. The elongated projection 58 extends along about the center of the beam 26 and is configured to slide within the track 38 formed between the bracket engaging wall bifurcations 36*a,b* when the display portion 14 is moved between the display and storage positions.

Figure 5:
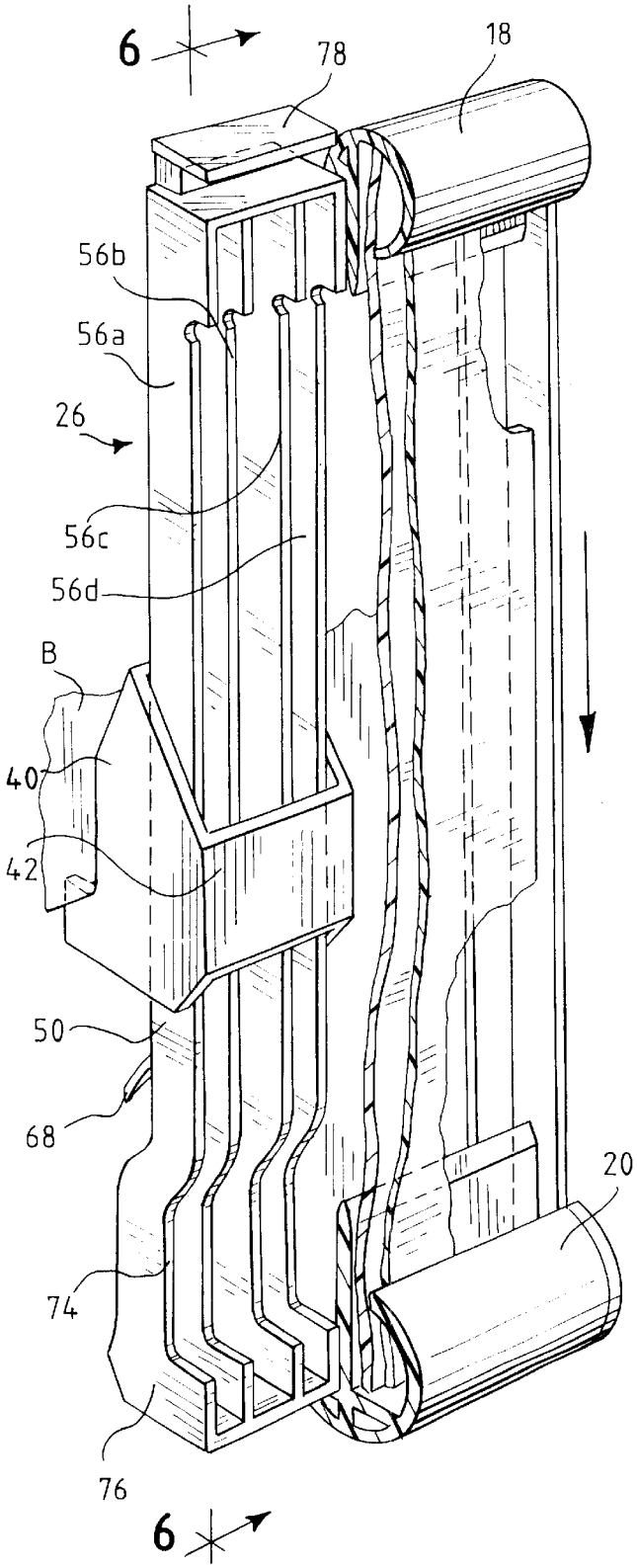
FIG. 5 is a partial, cross-sectional view of the vertically adjustable sign, shown in partial perspective view, to illustrate the mounting bracket and slide beam of the sign system.
Figure 6:
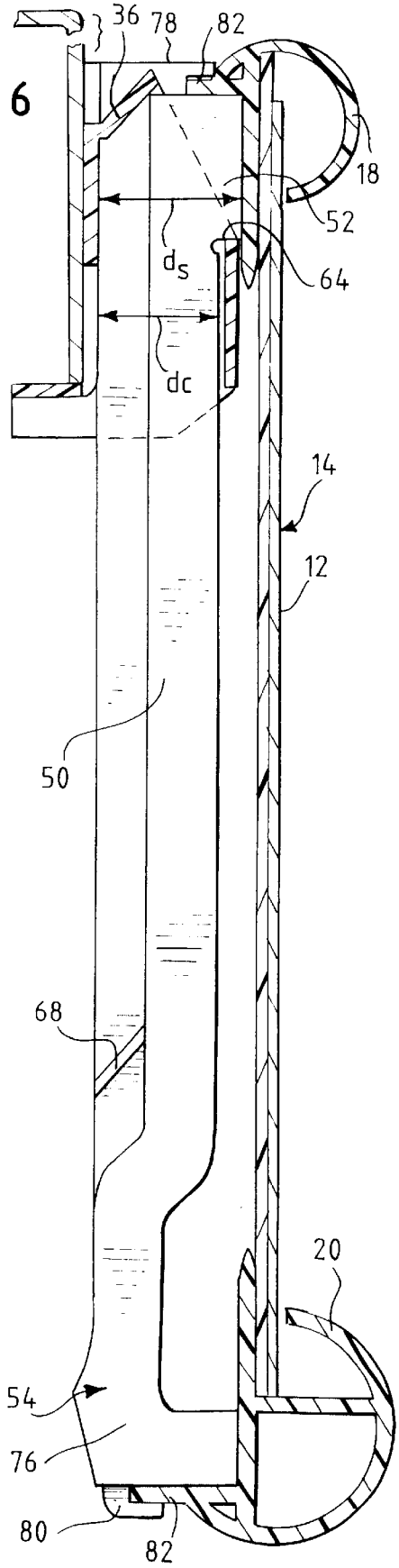
FIG. 6 is a partial, cross-sectional view taken along line 6—6 of FIG. 5, illustrating the sign in the full storage or restocking position.

Referring to FIGS. 5 and 6, the upper end termination portion 52 defines a stop element 62 that maintains the slide beam 26 in the storage position. In the illustrated embodiment, the stop element 62 is formed by a plurality of shoulders 64 formed in the ribs 56. The stop element 62 or shoulders 64 have a greater depth $d_s$ than the depth $d_c$ of the central portions 50 of the ribs 56 so that the upper end termination portion 52 engages the top edge 48 of the bracket front wall 42 and cannot fit through the bracket opening 44.

Figure 2:
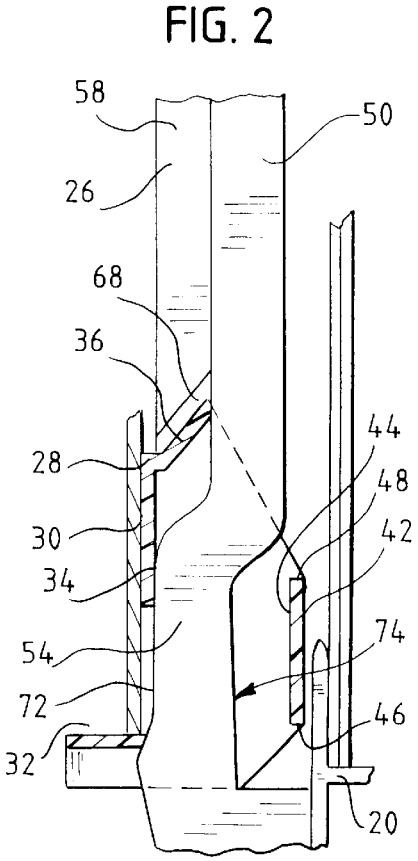
FIG. 2 is a partial, cross-sectional view of the sign of FIG. 1, illustrating the sign in the display position.
Figure 3:
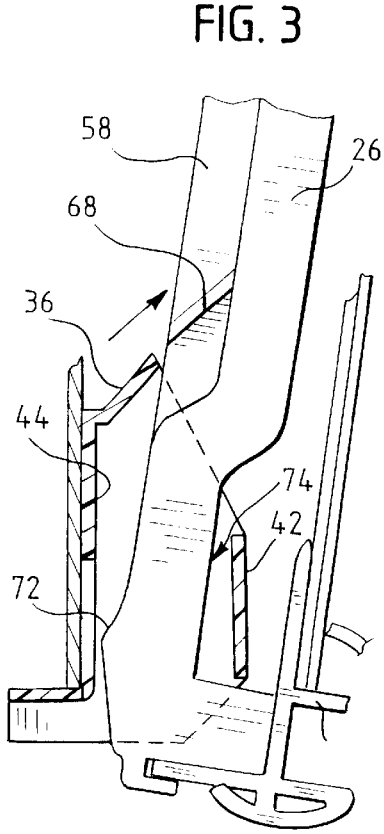
FIG. 3 is a cross-sectional view similar to FIG. 2, illustrating the sign being disengaged from the display position.
Figure 4:
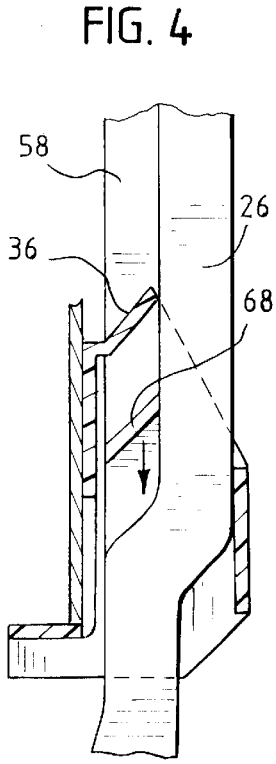
FIG. 4 is a cross-sectional view similar to FIGS. 2 and 3, in which the sign is being repositioned into the storage or restocking position.

The lower end termination portion 54 is configured to maintain the beam 26 and thus the display 14 in the display position. As shown in FIGS. 2–4, a pair of outwardly extending, inclined engaging flanges 68 extend from the rear 70 of the beam 26 at an angle that is complementary to that of the engaging wall 36 of the bracket 28. The flanges 68 are integral with the beam rear projection 58 and are configured to engage the engaging wall bifurcations 36*a, b* to maintain the display 14 in the display position. The lower end termination portion 54 further includes a pair of resting wall portions 72 that extend rearwardly from the beam 26 and abut the bracket 28 when in the display position. Abutting of the resting wall portions 72 to the bracket 28 prevents the display portion 14 from leaning forward due to the moment (i.e., angularly displaced force) of the display 14 about the flange-engaging wall 68–36 connection.

The lower end termination portion 54 is further configured to readily insert the beam 26 into the bracket opening 44 (e.g., assemble the beam 26 to the bracket 28). Referring to FIG. 7, the front of the beam 26 includes a transverse recessed portion, shown generally at 74, below the central portion 50. The lower end termination portion 54 terminates in an end wall 76 that extends forwardly to about the front of the beam 26, and has an L-shaped configuration. To insert the beam 26 into the bracket opening 44, the beam 26 is rotated about 90° clockwise (with reference to, and from the orientation shown in FIG. 7) to insert the end wall 76 into the opening 44. As the beam 26 is further inserted through the opening 44, the beam 26 is rotated upwardly until it is upright. The beam 26 can then be readily slid through the opening 44. Removal of the beam 26 from the bracket 28 is carried out in a reverse fashion.

The beams 26 connect to the display portion 14 at the upper and lower frame members 18, 20, as seen in FIG. 6. Both the upper and lower end termination portions 52, 54 of the beam 26 include transverse locking flanges 78, 80, respectively, that are each configured to receive a leg 82 that extends rearwardly from the respective frame members 18, 20. The frame members 18, 20 can then be secured to the beams 26 using fasteners, such as screws (not shown). Display media 12, such as a sign, poster or the like is positioned in the frame 16 with the frame end members 22 secured to the upper and lower frame members 18, 20.

As discussed above, in a preferred embodiment, the beam 26 is formed from a polymeric material, such as styrene and the like. The bracket 28 can be formed using similar materials. The beam 26 and bracket 28 can be formed using known molding techniques, such as injection molding and the like. It will be readily appreciated by those skilled in the art that the beam 26 and bracket 28, as well as the frame members 18–22 can be formed from a wide variety of materials and using a wide variety of different manufacturing processes, which other materials and processes are within the scope of the present invention.

Use of the present two-position vertically adjustable sign system 10 is straight-forward and readily understood from the above disclosure and the figures. After the beam 26 is inserted into the bracket opening 44, further lowering of the beam 26 through the opening 44 will engage the beam engaging flanges 68 with the bracket engaging wall 36, thus locking the sign 14 in the display position. To disengage the display 14 from the display position, the display portion 14 is raised slightly to disengage the beam engaging flanges 68 from the bracket engaging wall 36, and is leaned forward, slightly, as illustrated in FIG. 3. Once the beam engaging flanges 68 pass beyond the bracket engaging wall 36, as seen in FIG. 4, the beam 26 can be leaned rearwardly until it lies in a generally vertical plane, and then lowered to the storage or restocking position. The upper end termination stop element 62 prevents the display 14 from lowering beyond the top portion of the beam 26.

To adjust the sign 14 to the display position, the display portion 14 is slid upwardly until the beam engaging flanges 68 pass over the bracket engaging wall 36. The display portion 14 is then lowered slightly until the beam engaging flanges 68 rest on and engage the bracket engaging wall 36, thus securing the display 14 in the display position.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A two-position vertically adjustable sign system for mounting to an associated vertically oriented rack or shelf comprising:

a frame for supporting associated media, such as a sign or a poster, the frame including upper and lower frame members;

at least two mounting brackets for mounting to the shelf or rack, each bracket defining an opening therein and including an engaging wall extending from a rear portion of the bracket, the engaging wall being inclined and extending upwardly and away from the rear portion of the bracket; and a slide beam associated with each mounting bracket and fixedly connected to the frame at the upper and lower frame members, each beam being slidingly received in its respective mounting bracket opening for vertically adjusting the frame between a display position and a storage position, each beam including an engaging flange extending from a rear portion thereof for engagement with its respective bracket engaging wall to maintain the frame in the display position, each slide beam further including an upper end termination portion to secure to the frame and to maintain the frame in the storage position and a lower end termination portion for securing to the frame.

2. The two-position vertically adjustable sign system in accordance with claim 1 wherein the beam engaging flange is inclined complementary to the bracket engaging wall.

3. The two-position vertically adjustable sign system in accordance with claim 1 wherein the bracket engaging wall is bifurcated, defaming a pair of wall portions defining a track therebetween, and wherein the beam includes a rearwardly extending projection configured for receipt in the track, and wherein the beam engaging flange is formed as a pair of flanges, each of the pair extending from a respective side of the projection.

4. The two-position vertically adjustable sign system in accordance with claim 1 wherein the bracket includes a front wall that extends upwardly a height less than a height of the bracket engaging wall, and wherein the beam defines a recessed region on a front portion thereof at about the lower end termination portion, the front wall and the engaging wall being configured for cooperatively, pivotally positioning the lower end termination portion of the beam into the bracket opening.

* * * * *